US005746191A

United States Patent [19]

Isobe et al.

[11] Patent Number: 5,746,191

[45] Date of Patent: May 5, 1998

[54] EVAPORATIVE FUEL-PROCESSING SYSTEM FOR INTERNAL COMBUSTION ENGINES

[75] Inventors: Takashi Isobe; Takushi Toda, both of Wako, Japan

[73] Assignee: Honda Giken Kogyo Kabushiki Kaisha, Tokyo, Japan

[21] Appl. No.: 842,428

[22] Filed: Apr. 24, 1997

[30] Foreign Application Priority Data

Apr. 26, 1996 [JP] Japan ..... 8-131410

[51] Int. Cl.[6] ..... F02M 25/08; F02D 41/14

[52] U.S. Cl. ..... 123/686; 123/198 D; 123/520; 123/698

[58] Field of Search ..... 123/198 D, 520, 123/685, 686, 690, 698

[56] References Cited

U.S. PATENT DOCUMENTS

| | | | |
|---|---|---|---|
| 5,295,472 | 3/1994 | Otsuka et al. | 123/520 |
| 5,355,863 | 10/1994 | Yamanaka et al. | 123/520 |
| 5,614,665 | 3/1997 | Curran et al. | 73/118.1 |

FOREIGN PATENT DOCUMENTS 6-42415 2/1994 Japan .

*Primary Examiner*—Tony M. Argenbright
*Attorney, Agent, or Firm*—Nikaido, Marmelstein, Murray & Oram LLP

[57] ABSTRACT

An evaporative fuel-processing system for an internal combustion engine is comprised of an evaporative emission control system including a canister, a charging passage extending between the canister and the fuel tank, a purging passage extending between the canister and the intake system of the engine, a purge control valve, and a vent shut valve. A pressure sensor detects the pressure within the evaporative emission control system. The interior of the evaporative emission control system is negatively pressurized into a predetermined negatively pressurized state, by opening the purge control valve and closing the vent shut valve. Then, the purge control valve is closed, and leakage from the evaporative emission control system is checked based on the rate of decrease in negative pressure within the evaporative emission control system over a first predetermined time period. An amount of evaporative fuel supplied from the canister to the engine is detected, and when the detected amount of evaporative fuel exceeds a predetermined amount, the abnormality determination of the evaporative emission control system is terminated. The predetermined amount is changed in a direction of mitigating conditions for the abnormality determination over a second predetermined time period after starting of the engine in a cold state.

5 Claims, 11 Drawing Sheets

START
S83
PREDETERMINED OPERATING CONDITION?
NO
YES
S84
PBG≧PBGLM ?
NO
YES
S85
PCON<PL1MH ?
NO
YES
S86
NO
TMATMPAS=0 ?
YES
S87
PTKATM< PATMLMH ?
NO
YES
S88
QPAIRT> QPTLMTCA ?
NO
YES
S89
KO2×KEVAP> KEVPELK ?
NO
S97
QPTLMTCA←QLMTPURG
QPAIRT←0
YES
S90
KEVAPREF> KEVPELK ?
NO
YES
S91
tLKTANKD=0 ?
NO
YES
FTANKM←1
S92
S94
SET tLKTANKD
S95
PCON←PTANK
FTANKM←0
S96
END

LEAKAGE CHECKING MODE
S31
FEVP2=1 ?
NO
YES
S32
EXECUTE LEAKAGE CHECKING
BPS CLOSE
VSSV CLOSE
PCS CLOSE
S33
T≧T21 ?
NO
YES
S34
P1←PTANK
S35
T≧T22 ?
NO
YES
S36
P2←PTANK
S37
T≧T23 ?
NO
YES
S38
P3←PTANK
S39
T≧T2 ?
NO
YES
S40
DP2←PTANK−P2
S41
FEVP2←0
FEVP3←1
T←0
EXIT

CORRECTIVE CHECKING MODE
S71
FEVP4=1 ?
NO
YES
S72
EXECUTE CORRECTIVE CHECKING
BPS CLOSE
VSSV CLOSE
PCS CLOSE
S73
T≧T41 ?
NO
S74
P4←PTANK
YES
S75
T≧T4 ?
NO
YES
S76
DP4←PTANK−P4
S77
DP3−DP4 <PT4 ?
NO (LEAKAGE OF φ 0.04inch)
S79
YES
S78
DETERMINE THAT EVAPORATIVE PURGING SYSTEM IS NORMAL
DETERMINE THAT EVAPORATIVE PURGING SYSTEM IS ABNORMAL
S80
TERMINATE MONITORING
EXIT

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which purges evaporative fuel generated in the fuel tank into the intake system of the engine, and more particularly to an evaporative fuel-processing system of this kind, which has a function of determining whether or not abnormality exists in an evaporative emission control system which extends from the fuel tank to the intake system of the engine.

2. Prior Art

Conventionally, there is known an abnormality-determining method which determines whether leakage occurs in an evaporative emission control system of an internal combustion engine, which includes a canister for adsorbing evaporative fuel generated in the fuel tank, and a purging passage connecting between the canister and the intake system of the engine. According to the method, negative pressure within the intake system of the engine is introduced into the evaporative emission control system to carry out negative pressurization thereof, and then the evaporative emission control system is sealed, to thereby determine whether or not the evaporative emission control system undergoes leakage, depending on the state of the negative pressure held within the evaporative emission control system (leakage checking).

Further, there has been proposed an evaporative fuel processing system, for example, by Japanese Laid-Open Patent Publication (Kōkai) No. 6-42415, which employs the above-mentioned method. The proposed evaporative fuel-processing system is constructed such that the amount of evaporative fuel is detected based on fluctuations in an air-fuel ratio correction coefficient which is used in the air-fuel ratio control of a mixture supplied to the engine and set based on an output from an oxygen concentration sensor, and if the detected amount of evaporative fuel exceeds a predetermined value, i.e. if the air-fuel ratio correction coefficient falls below a predetermined threshold value, it is determined that the amount of evaporative fuel generated in the fuel tank is excessive, and accordingly the amount of evaporative fuel stored in the canister is excessive, and therefore abnormality determination of the evaporative emission control system is inhibited.

This is because if the leakage checking of the evaporative emission control system is carried out with an excessive amount of evaporative fuel generated in the fuel tank and hence an excessive amount of evaporative fuel stored in the canister, the drivability of the engine can be degraded during the negative pressurization of the evaporative emission control system, and further, it can be erroneously determined that the system undergoes leakage, due to the excessive amount of evaporative fuel even when the system is functioning normally. However, frequent inhibition of the leakage checking brings about an inconvenience that the frequency of leakage checking is reduced.

SUMMARY OF THE INVENTION

It is the object of the invention to provide an evaporative fuel-processing system for internal combustion engines, which is capable of increasing the frequency of leakage checking of an evaporative emission control system of the engine by mitigating the conditions for permitting the leakage checking when the engine is operating in a region where there is almost no possibility of erroneous detection of leakage due to an excessive amount of evaporative fuel in the fuel tank or the canister, while preventing the erroneous detection and at the same time ensuring good drivability of the engine.

To attain the above object, the present invention provides an evaporative fuel-processing system for an internal combustion engine having an intake system, and a fuel tank, comprising:

an evaporative emission control system including a canister having an adsorbent accommodated therein, for adsorbing evaporative fuel generated in the fuel tank, and an air inlet port communicating with atmosphere, a charging passage extending between the canister and the fuel tank, a purging passage extending between the canister and the intake system, a purge control valve arranged across the purging passage, and a vent shut valve disposed to open and close the air inlet port of the canister;

abnormality-determining means for determining an abnormality in the evaporative emission control system, the abnormality-determining means including pressure-detecting means for detecting pressure within the evaporative emission control system, negatively pressurizing means for negatively pressurizing an interior of the evaporative emission control system into a predetermined negatively pressurized state, by opening the purge control valve and closing the vent shut valve, and leakage-checking means for closing the purge control valve, and for determining whether the evaporative emission control system has leakage, based on a rate of decrease in negative pressure within the evaporative emission control system over a first predetermined time period;

evaporative fuel amount-detecting means for detecting an amount of evaporative fuel supplied from the canister to the engine;

terminating means for terminating operation of the abnormality-determining means when the amount of evaporative fuel detected by the evaporative fuel amount-detecting means exceeds a predetermined amount; and changing means for changing the predetermined amount in a direction of mitigating operation of the terminating means over a second predetermined time period after starting of the engine in a cold state.

Preferably, the engine has oxygen concentration-detecting means arranged in the exhaust system, and air-fuel ratio control means for controlling an air-fuel ratio of an air-fuel mixture supplied to the engine by using an air-fuel ratio correction coefficient which is set in response to an output from the oxygen concentration-detecting means, the evaporative fuel amount-detecting means detecting the amount of evaporative fuel, based on the air-fuel ratio correction coefficient.

More preferably, the changing means sets the predetermined amount to a value smaller than a value set when the engine is started in a non-cold state or after the second predetermined time period has elapsed, over the second predetermined time period after the starting of the engine in the cold state.

Further preferably, the air-fuel ratio control means controls the air-fuel ratio of the air-fuel mixture by using an evaporative fuel-dependent correction coefficient which is set in response to an amount or concentration of evaporative fuel supplied to the intake system through the purging passage, together with the air-fuel ratio correction coefficient, the evaporative fuel amount-detecting means detecting the amount of evaporative fuel, based on the air-fuel ratio correction coefficient and the evaporative fuel-dependent correction coefficient.

Preferably, the changing means changes the predetermined amount in the direction of mitigating the operation of the terminating means over the second predetermined time period after the engine is started under a condition that temperature of coolant of the engine and temperature of intake air supplied to the engine are both within respective predetermined low ranges and a difference between the temperature of the coolant of the engine and the temperature of the intake air is below a predetermined value.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
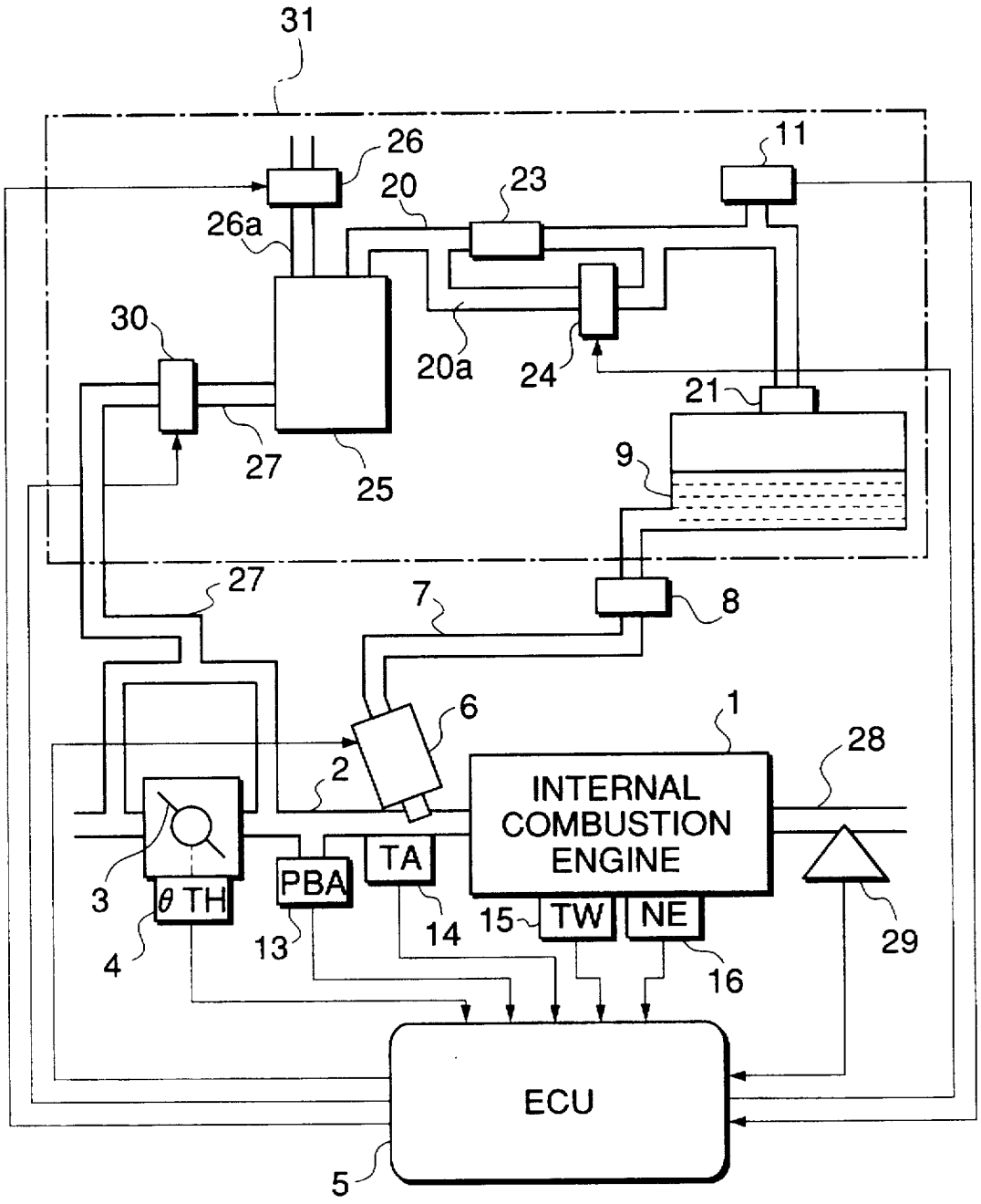
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine and an evaporative fuel-processing system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2, in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA. These sensors supply electric signals indicative of the respective sensed parameters to the ECU 5.

An engine coolant temperature (TW) sensor 15 formed of a thermistor or the like is inserted into a coolant passage formed in the cylinder block, which is filled with an engine coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the signal pulse being supplied to the ECU 5.

Arranged in an exhaust pipe 28 of the engine 1 is an 02 sensor 29 as an exhaust gas component concentration sensor for detecting the concentration of oxygen present in exhaust gases from the engine, and supplying a signal indicative of the sensed oxygen concentration to the ECU 5.

Next, an evaporative emission control system (hereinafter referred to as "the evaporative purging system") 31 will be described, which is comprised of the fuel tank 9, a charging passage 20, a canister 25, a purging passage 27, etc.

The fuel tank 9 is connected to the canister 25 via the charging passage 20 extending between the fuel tank 9 and the canister 25. A cut-off valve 21 is arranged at one end of the charging passage 20 connected to the fuel tank 9. The cut-off valve 21 is a float valve which closes when the fuel tank 9 is full or when it is sharply tilted. A pressure sensor 11 is inserted into the charging passage 20, for supplying a signal indicative of the sensed pressure within the charging passage 20 to the ECU 5.

Further arranged across the charging passage 20 is a two-way valve 23 which is constructed and disposed such that it opens when pressure PTANK within the fuel tank 9 (tank internal pressure) is higher than atmospheric pressure by approximately 10 mmHg or more or when the tank internal pressure PTANK is lower than pressure on one side of the two-way valve 23 close to the canister 25 by a predetermined amount or more.

Further connected to the charging passage 20 is a bypass passage 20*a* which bypasses the two-way valve 23. Arranged across the bypass passage 20*a* is a bypass valve (BPS; charging valve) 24 which is a normally-closed solenoid valve, and is opened and closed during execution of abnormality determination, described hereinafter, by a signal from the ECU 5.

The canister 25 contains activated carbon for adsorbing evaporative fuel, and has formed therein an air inlet port, not shown, which communicates with the atmosphere via a passage 26*a*. Arranged across the passage 26*a* is a vent shut valve (VSSV) 26, which is a normally-open solenoid valve, and is temporarily closed during execution of the abnormality determination, by a signal from the ECU 5.

The canister 25 is connected via the purging passage 27 to the intake pipe 2 at locations downstream and immediately upstream of the throttle valve 3. The purging passage 27 has a purge control valve (PCS) 30 arranged thereacross, which is a solenoid valve which is adapted to control the flow rate of a mixture of evaporative fuel and air so as to continuously change the same as the on/off duty ratio of a control signal supplied to the valve from the ECU 5 is changed. Alternatively, the purge control valve 30 may be a linear solenoid valve whose valve lift can be linearly changed. If the alternative valve is used, a current signal indicative of the valve lift is supplied to the valve from the ECU 5 in place of the control signal indicative of the on/off duty ratio.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, bypass valve 24, vent shut valve 26, and purge control valve 30.

The CPU of the ECU 5 operates in response to the above-mentioned various engine parameter signals from the various sensors to determine operating conditions in which the engine 1 is operating, such as an air-fuel ratio feedback control region where the air-fuel ratio is controlled to a stoichiometric value, in response to the oxygen concentration in exhaust gases detected by the 02 sensor 29, and air-fuel ratio open-loop control regions, calculates, based upon the determined engine operating conditions, a fuel injection period TOUT over which the fuel injection valve 6 is to be opened and the duty ratio of the purge control valve 30, and executes abnormality determination of the evaporative purging system 31 (determination as to leakage), based on a signal from the pressure sensor 11.

The fuel injection by the fuel injection valve 6 is executed in synchronism with generation of TDC signal pulses, and the fuel injection period TOUT is calculated by the use of the following equation (1):

$$TOUT=TI\times KO2\times KEVAP\times K1+K2 \quad (1)$$

where TI represents a basic value of the fuel injection period TOUT of the fuel injection valves 6, which is determined based on the engine rotational speed NE and the intake pipe absolute pressure PBA. A TI map for determining the TI value is stored in the memory means.

KO2 represents an air-fuel ratio correction coefficient which is determined based on an output from the O2 sensor 29 when the engine 1 is operating in the air-fuel ratio feedback control region, while it is set to predetermined values corresponding to the respective operating regions of the engine when the engine 1 is in the air-fuel ratio open-loop control regions. In the air-fuel ratio feedback control region, the air-fuel ratio correction coefficient KO2 is calculated by executing proportional control such that a well-known proportional term (P term) is added to the KO2 value when the output from the O2 sensor 29 is inverted with respect to a reference value (corresponding to a stoichiometric air-fuel ratio), while it is calculated by executing integrated control such that a well-known integrated term (I term) is added to the KO2 value when the output from the O2 sensor 29 is not inverted. The KO2 value is basically set to a value smaller than 1.0 when the oxygen concentration in exhaust gases is higher than the reference value, while it is set to a value larger than 1.0 when the oxygen concentration is lower than the reference value.

KEVAP represents an evaporative fuel-dependent correction coefficient for compensating for the influence of purged evaporative fuel on the air-fuel ratio control, which is supplied to the engine 1 in addition to fuel injected. The coefficient KEVAP is set to 1.0 when purging is not carried out, while it is set to a value between 0 and 1.0 when purging is carried out. More specifically, it is basically set to a smaller value (<1.0 ) as the amount or concentration of evaporative fuel supplied to the engine is larger. Therefore, the coefficient KEVAP, when set to a smaller value, indicates that the influence of the purged evaporative fuel is larger. The coefficient KEVAP is changed by a predetermined amount every predetermined time period when the value KO2 falls out of a predetermined range determined by a learned value KREF (=cKO2 +(1−c)×KREF, where c represents a variable between 0 and 1). Further, a learned value KEVAPREF of the coefficient KEVAP is calculated by the use of the following equation (2):

$$KEVAPREF=cKEVAP+(1-c)\times KEVAPKREF \quad (2)$$

where c represents a variable between 0 and 1.

Details of the calculation of the evaporative fuel-dependent correction coefficient KEVAP is disclosed in U.S. Pat. No. 5,469,833 assigned to the assignee of the present application.

K1 and K2 represent other correction coefficients and correction variables, respectively, which are set according to engine operating parameters to such values as optimize engine operating characteristics, such as fuel consumption and engine accelerability.

The CPU of the ECU 5 outputs signals for driving the fuel injection valves 7 and the purge control valve 30, based on results of the calculation.

Figure 2:
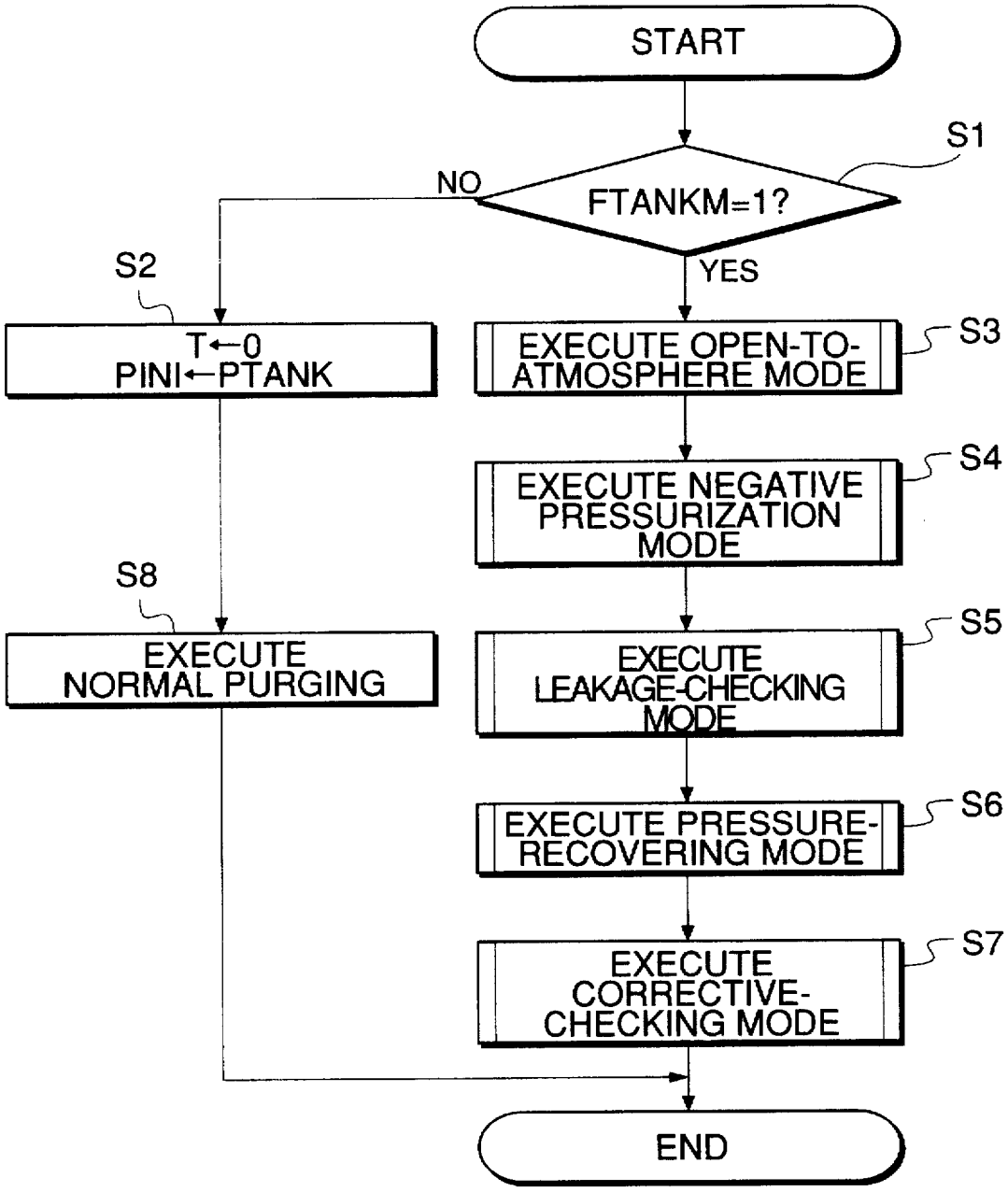
FIG. 2 is a flowchart showing a main routine for carrying out a determination as to abnormality of an evaporative emission control system appearing in FIG. 1.

FIG. 2 shows a main routine for carrying out abnormality determination of the evaporative purging system 31, which is executed, for example, at predetermined time intervals.

First, at a step S1, it is determined whether or not an abnormality determination permission flag FTANKM is set to "1". The flag FTANKM, when set to "1", indicates that monitoring conditions for executing abnormality determination of the evaporative purging system are satisfied.

Figure 3:
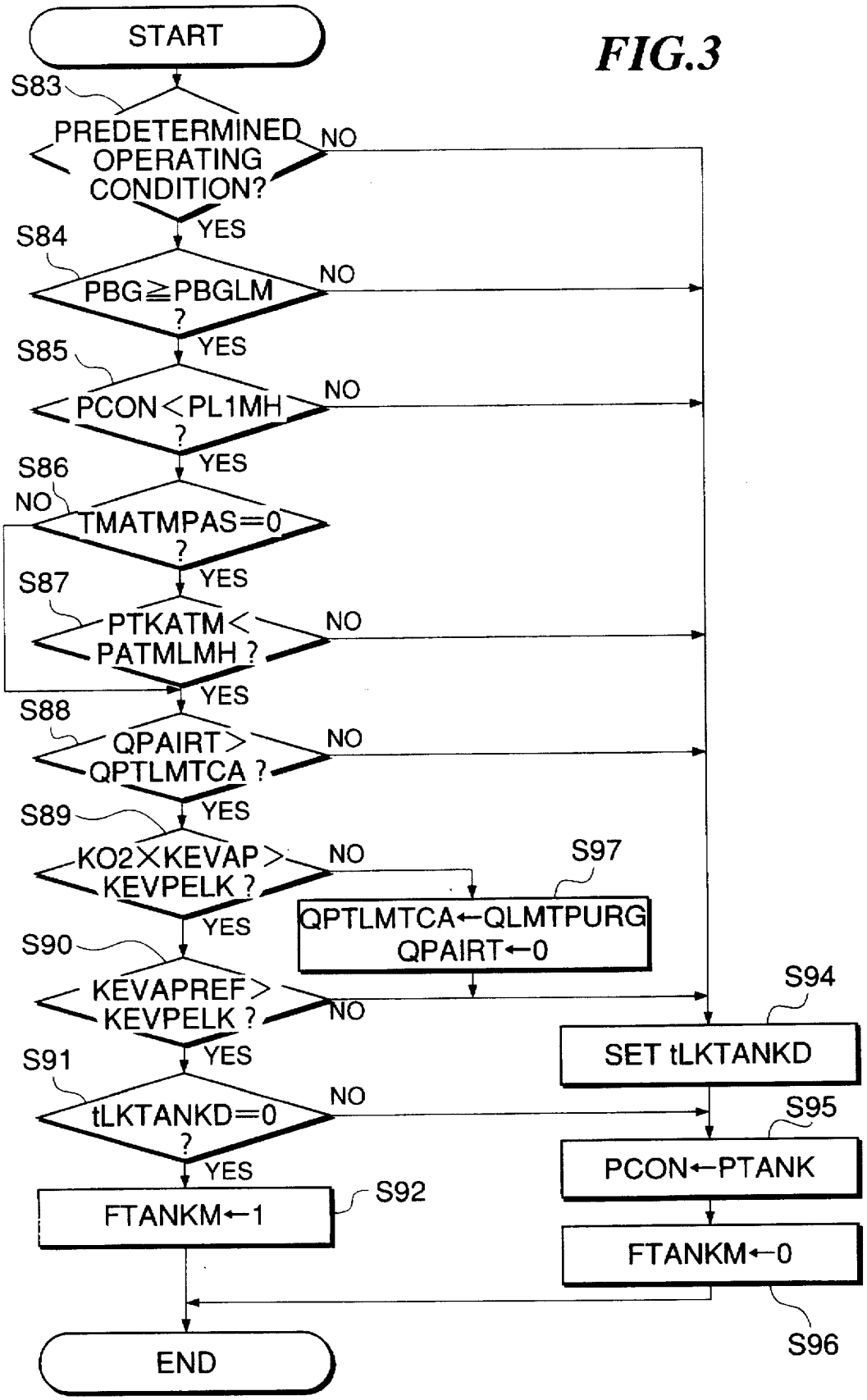
FIG. 3 is a flowchart showing a subroutine for determining whether or not conditions for permitting execution of the abnormality determination are satisfied, which is executed at a step Si in FIG. 2.

FIG. 3 shows a subroutine for determining the satisfaction of the monitoring conditions for the abnormality determination, which is executed at the step S1 in FIG. 2. This subroutine is executed at predetermined time intervals (e.g. 80 msec).

First, at a step S83, it is determined whether or not the engine 1 is operating in a predetermined operating condition. The predetermined operating condition is satisfied when the intake air temperature TA, the engine coolant temperature TW, the throttle valve opening θTH, and the intake pipe absolute pressure PBA are all within respective predetermined moderate ranges.

If the answer is affirmative (YES), the program proceeds to a step S84, wherein a difference PBG between the atmospheric pressure PATM and the intake pipe absolute pressure PBA is larger than a predetermined lower limit value PBGLM. If the answer is affirmative (YES), which means that the engine 1 can generate power required for producing negative pressure for the leakage-checking, the program proceeds to a step S85. At the step S85, it is determined whether or not tank internal pressure (initial pressure) PCON assumed before execution of the abnormality determination, which is set at a step S95 referred to hereinafter, is below a predetermined upper limit value PL1MH. If the answer is affirmative (YES), it is determined that the amount of evaporative fuel is not large, followed by the program proceeding to a step S86.

At the step S86, it is determined whether or not the value of a down-counting timer TMATMPAS is equal to 0. The timer TMATMPAS is set to a predetermined time period, e.g. 420 sec, when the engine has just been started, the intake air temperature TA and the engine coolant temperature TW are both within a range from 0°to +35° C., and at the same time the absolute value of the difference between the values TA and TW is within 10° C. The timer TMATMPAS is set to 0 seconds, if the above conditions are not satisfied. If the answer is affirmative (YES), it is determined that the predetermined time period has elapsed from the start of the engine 1, and then the program proceeds to a step S87, wherein it is determined whether or not tank internal pressure PTKATM assumed after the open-to-atmosphere mode processing is below a predetermined upper limit value PATMLMH. If the answer is affirmative (YES), it is determined that the amount of evaporative fuel is not large, followed by the program proceeding to a step S88.

If it is determined at the step S86 that the value of the timer TMATMPAS is not equal to 0, it is determined that the engine has just been started, and then the program skips over the step S87 to the step S88.

At the step S88, it is determined whether or not a cumulative value QPAIRT of the purged flow rate is larger than a predetermined value QPTLMTCA. If the answer is affirmative (YES), it is determined that the amount of evaporative fuel stored in the canister 25 is not large and at the same time purging of evaporative fuel is accelerated so that execution of the abnormality determination will not cause large fluctuations in the air-fuel ratio. The cumulative value QPAIRT of the purged flow rate is obtained by cumulating values of the purged flow rate, which have been calculated from the start of the engine 1 to the present loop, based on the opening value of the purge control valve 30 and a pressure difference PBG between pressure upstream of the valve 30 and pressure downstream thereof.

If the cumulative value QPAIRT exceeds the predetermined value QPTLMTCA at the step S88, the program proceeds to a step S89, wherein a fuel injection amount correction term (air-fuel ratio correction coefficient KO2 ×evaporative fuel-dependent correction coefficient KEVAP) is calculated, and it is determined whether or not the calculated fuel injection amount correction term exceeds a predetermined value KEVPELK.

The predetermined value KEVPELK functions as a leakage-checking-inhibiting threshold value, which is determined in the following manner:

That is, if the leakage checking of the evaporative purging system is carried out while the amount of evaporative fuel generated in the fuel tank 9 or stored in the canister 25 is excessive, there is a fear of an erroneous determination being rendered that leakage occurs, due to the excessive amount of evaporative fuel in the fuel tank 9 or the canister 25. The value KEVAP assumes a smaller value than 1.0 as the amount of evaporative fuel becomes larger, and therefore it is desirable that the predetermined value KEVPELK should be set to a value closer to 1.0 from the viewpoint of avoiding the erroneous determination due to the influence of the evaporative fuel. If the predetermined value KEVPELK becomes closer to 1.0, however, the conditions for permission of the leakage checking becomes severer accordingly, whereby reduce the frequency of the leakage checking becomes reduced.

Figure 4:
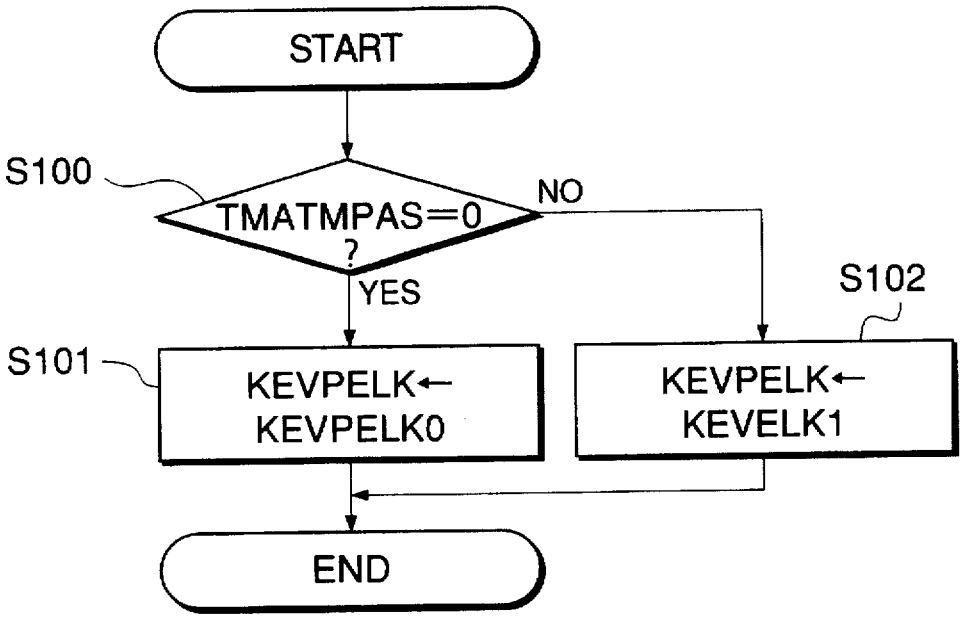
FIG. 4 is a flowchart showing a subroutine for changing a predetermined value KEVPELK used at a step S89 in FIG. 3.

To overcome the above-mentioned inconvenience, according to the present embodiment, the predetermined value KEVPELK is changed. FIG. 4 shows a subroutine for carrying out a KEVPELK-changing processing, which is executed at the step S89 in FIG. 3.

First, at a step S100, it is determined whether or not the value of the timer TMATMPAS is equal to 0. If the answer is affirmative (YES), which means that the predetermined time period has elapsed from the start of the engine 1, the program proceeds to a step S11, wherein the predetermined value KEVPELK is set to a value KEVPELK0 (=0.813), followed by terminating the present routine. On the other hand, if the value of the timer TMATMPAS is not equal to 0, which means that the engine has just been started, the program proceeds to a step S102, wherein the predetermined value KEVPELK is set to a value KEVPELK1 (=0.5), followed by terminating the present routine.

That is, if the predetermined time period set by the timer TMATMPAS has not elapsed from the start of the engine 1, the predetermined value KEVPELK is set to the value KEVPELK1 (=0.5) which is smaller than the predetermined value KEVPELK0 (=0.813) suitable for a steady operating condition of the engine 1.

Referring again to FIG. 3, if the fuel injection amount correction term (air-fuel ratio correction coefficient KO2 ×evaporative fuel-dependent correction coefficient KEVAP) exceeds the predetermined value KEVPELK, it is determined that the influence of evaporative fuel on the abnormality determination is small. Then, at a step S90, it is determined whether or not the learned value KEVAPREF of the evaporative fuel-dependent correction coefficient KEVAP exceeds the predetermined value KEVPELK. If the answer is affirmative (YES), it is determined that the influence of evaporative fuel on the abnormality determination is small, followed by the program proceeding to a step S91. At the step S91, it is determined whether or not the value of a timer tLKTANKD, which is set at a step S94, referred to hereinbelow, is equal to 0.

If the answer is affirmative (YES), it is determined that a predetermined time period has elapsed after the abnormality determination-permitting conditions became satisfied, and the abnormality determination permission flag FTANKM is set to "1" at a step S92, followed by terminating the present routine.

More specifically, even if the the conditions for permitting the abnormality determination (the steps S83 to S90) become satisfied, the abnormality determination is inhibited until the value of the timer tLKTANKD set at the step S94 becomes equal to 0, i.e. until the predetermined time period elapses after the satisfaction of the conditions. When the value of the timer tLKTANKD becomes equal to "0", the abnormality determination is carried out.

On the other hand, if any of the answers to the questions of the steps S83, S84, S85 and S87 is negative (NO), it is determined that the conditions are not satisfied, and therefore the down-counting timer tLKTANKD is set to the predetermined time period at the step S94. Then, the initial pressure PCON is set to a value of the tank internal pressure PTANK read in in the present loop at the step S95, and the abnormality determination permission flag FTANKM is set to "0" at a step S96, followed by terminating the present routine.

If it is determined at the step S89 that the fuel injection amount correction term (air-fuel ratio correction coefficient KO2 x evaporative fuel-dependent correction coefficient KEVAP) is below the predetermined value KEVPELK, which means that the influence of evaporative fuel on the abnormality determination is large, the program proceeds to a step S97, wherein the predetermined value QPTLMTCA of the cumulative value QPAIRT of the purged evaporative fuel is set to a predetermined value QLMTPURG and at the same time the cumulative value QPAIRT is set to 0, and then the steps S94 to S96 are executed, followed by terminating the present routine. Further, if the answer to the question of the step S90 is negative (NO), it is determined that the influence of evaporative fuel on the abnormality determination is large, and therefore the steps S94 to S96 are executed, followed by terminating the present routine.

Further, if the answer to the question of the step S91 is negative (NO), it is determined that the predetermined time period has not elapsed after it was determined loop that the conditions for permitting the abnormality determination were not satisfied, and therefore the steps S95 and S96 are executed, followed by terminating the present routine.

Referring again to FIG. 2, if the answer to the question of the step S1 is negative (NO), initialization is carried out at a step S2, and normal purging is executed at a step S8, followed by terminating the present routine. The initialization is carried out such that an up-counting timer T to be used for processings described hereinafter is reset to "0", and an output value from the pressure sensor 11 (hereinafter referred to as "the tank internal pressure PTANK") generated at this time is stored as an initial pressure PINI. At the same time, if conditions for carrying out purging are then satisfied, the normal purging is carried out by closing the bypass valve 24, opening the vent shut valve 26, and controlling the purge control valve 30, based on the duty ratio.

If the monitoring conditions are satisfied at the step S1, i.e. if the flag FTANKM is set to "1", an open-to-atmosphere mode processing (at a step S3), a negative pressurization mode processing (at a step S4), a leakage-checking mode processing (at a step S5), a pressure-recovering mode processing (at a step S6), and a corrective checking mode processing(at a step S7) are sequentially executed, followed by terminating the abnormality determination.

Figure 5:
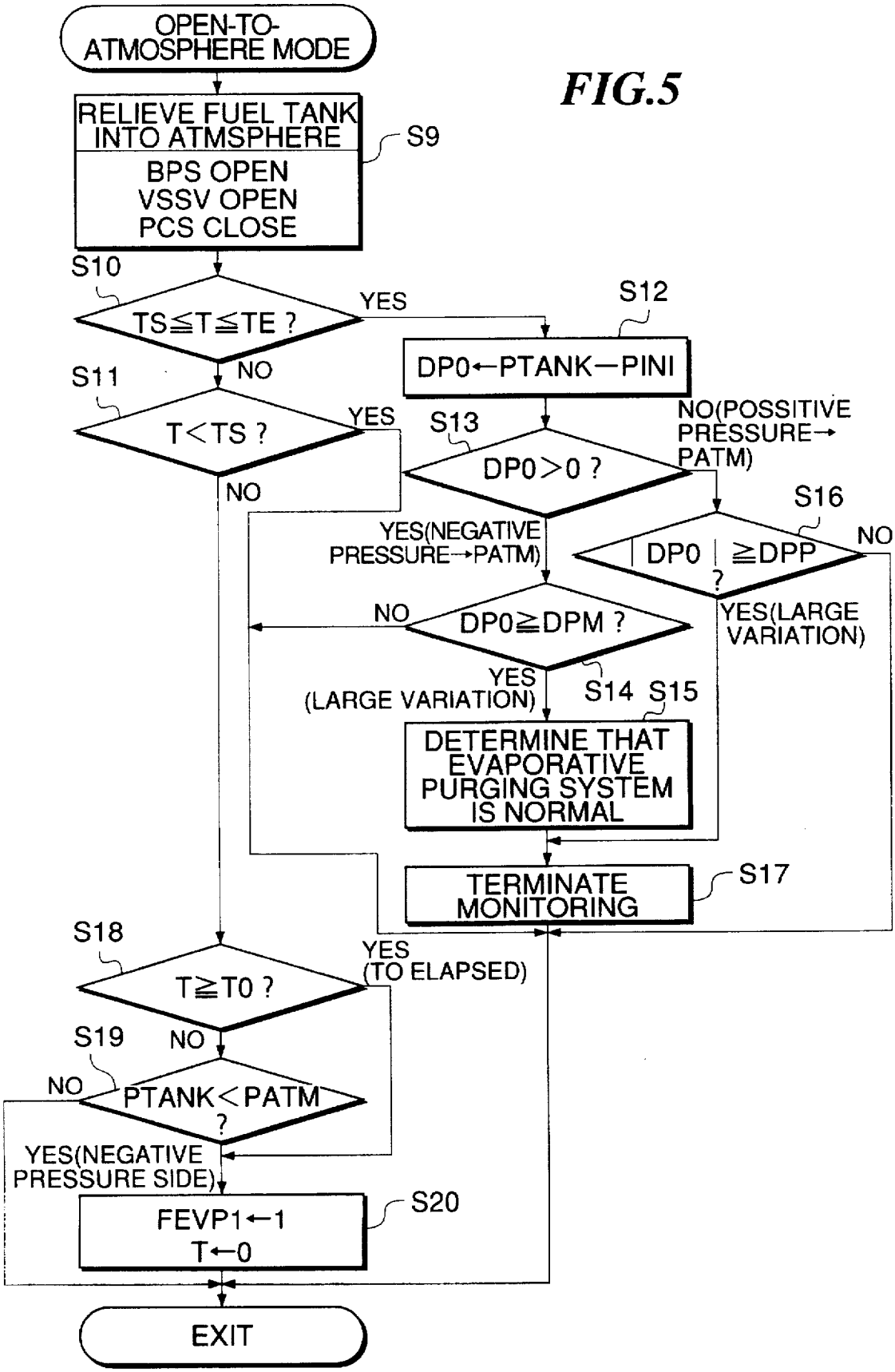
FIG. 5 is a flowchart showing a subroutine for carrying out an open-to-atmosphere mode processing, which is executed at a step S3 in FIG. 2.
Figure 11:
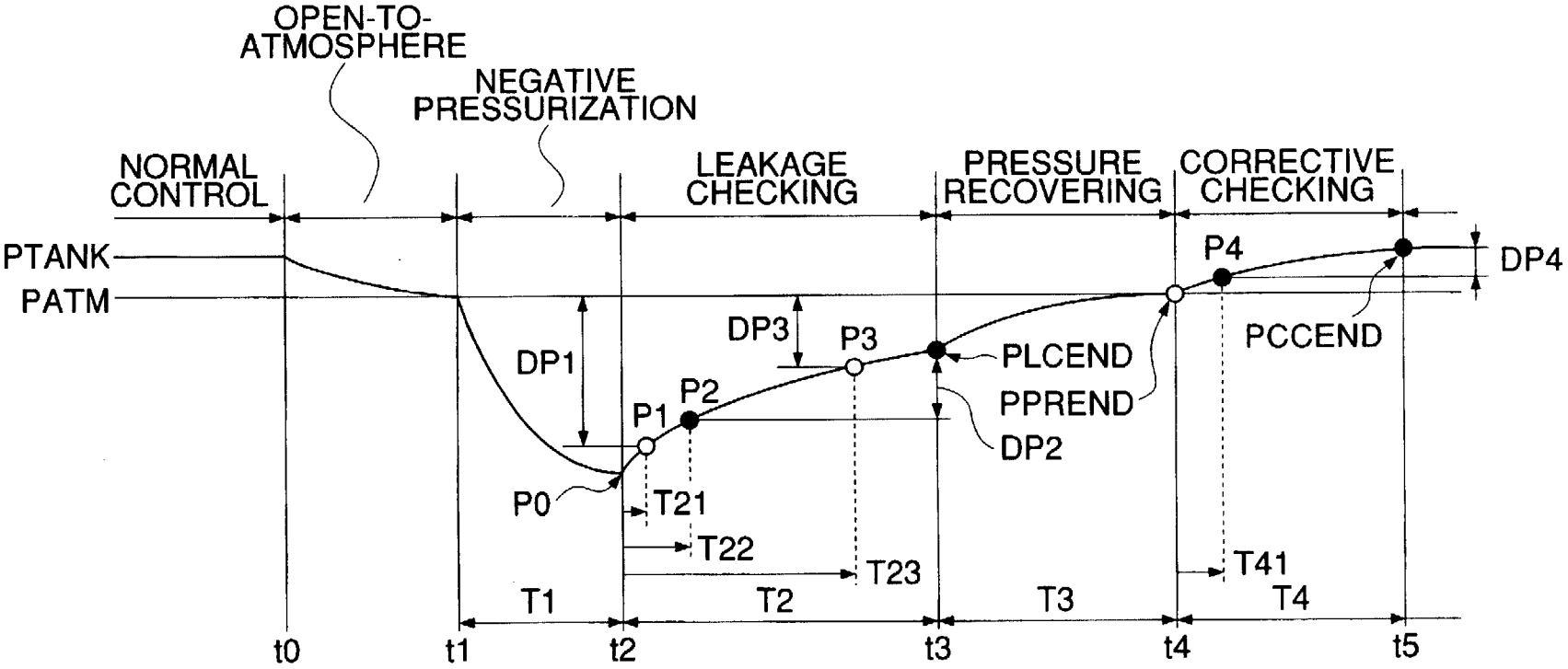
FIG. 11 is a timing chart showing changes in the tank internal pressure PTANK with the lapse of time.

FIG. 5 shows a subroutine for carrying out the open-to-atmosphere mode processing executed at the step S3 in FIG. 2 (corresponding to a time point t0 to a time point ti in FIG. 11).

First, at a step S9, the open-to-atmosphere mode is set by opening the bypass valve 24 and the vent shut valve 26, and closing the purge control valve 30. Then, it is determined at a step S10 whether or not the value of the timer T is larger than a first predetermined time period TS and at the same time smaller than a second predetermined time period TE. In the first loop of execution of the step S10, T<TS holds, and then the program proceeds to a step S11, wherein it is determined whether or not the value of the timer T is smaller than the first predetermined time period TS. In the first loop of execution of the step S11, the answer is affirmative (YES), and then the program is immediately terminated. The first and second predetermined time periods TS and TE satisfy the relationship of TS<TE<TO (where TO represents a predetermined open-to-atmosphere time period, referred to hereinafter).

Thereafter, when the first predetermined time period TS has elapsed but the second predetermined time period TE has not elapsed, the program proceeds to a step S12, wherein a difference DP0 (=PTANK−PINI, hereinafter referred to as "the initial change rate") between a present value of the tank internal pressure PTANK and the initial pressure PINI read in by the initialization executed at the step S2 in FIG. 2 is calculated. Then, it is determined at a step S13 whether or not the initial change rate DP0 is positive. If DP0 <0 holds, which means that the tank internal pressure PTANK has been or is being reduced, it is determined at a step S16 whether or not the absolute value |DP0 |of the initial change rate DP0 is larger than a positive predetermined value DPP.

Figure 6B:
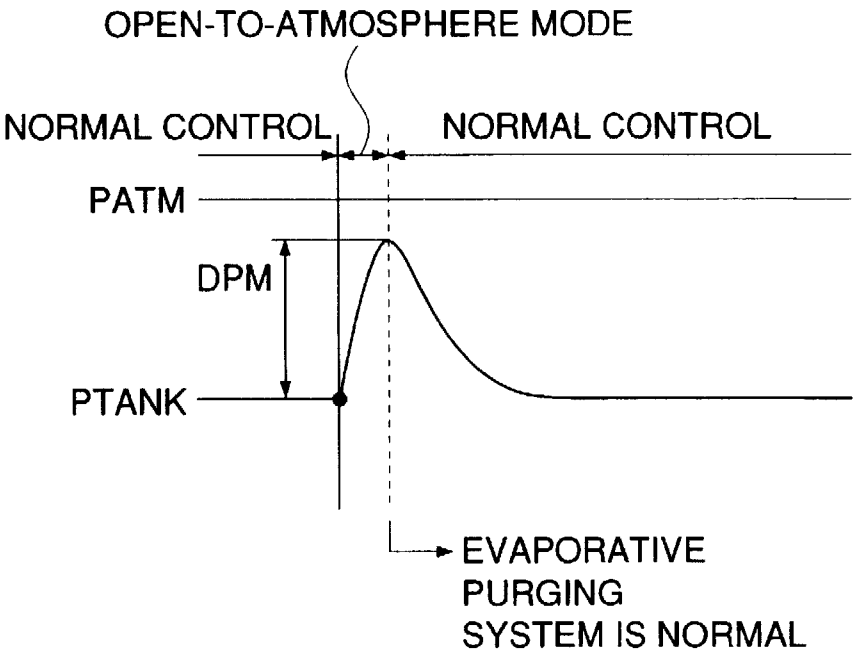
FIG. 6B is a graph useful in explaining a case where the evaporative emission control system is determined to be normal during execution of the open-to-atmosphere mode processing.
Figure 6A:
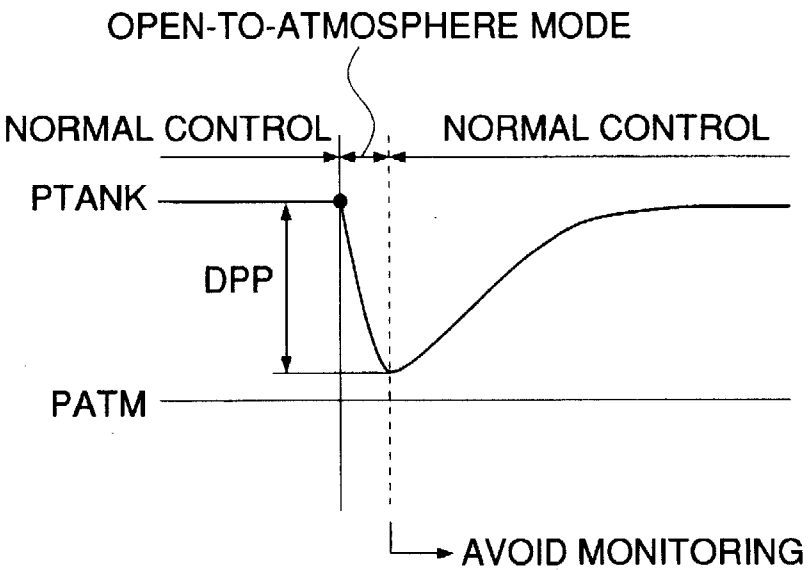
FIG. 6A is a graph useful in explaining a case where the abnormality determination is immediately terminated during execution of the open-to-atmosphere mode processing due to generation of a large amount of evaporative fuel.

If |DP0 |≧DPP holds, which means that the initial pressure PINI is so high that the absolute value of the initial change rate DP0 exceeds the positive predetermined value DPP before the tank internal pressure PTANK reaches the atmospheric pressure, as shown in FIG. 6A, it is presumed that a large amount of evaporative fuel is generated in the fuel tank 9. Therefore, the abnormality determination is immediately terminated, that is, the abnormality determination is suspended in order to prevent a misjudgment at a step S17. On the other hand, if |DP0 |<DPP holds at the step S16, the program is immediately terminated.

If DP0 >0 holds at the step S13, it is determined at a step S14 whether or not the DP0 value is larger than a negative predetermined value DPM. If DP0 24 DPM holds, which means that the initial pressure PINI is negative and the initial change rate DP0 exceeds the negative predetermined value DPM before the tank internal pressure PTANK reaches the atmospheric pressure, as shown in FIG. 6B. Therefore, it is presumed that the tank internal pressure PTANK had been held negative before the open-to-atmosphere mode processing was started, so that it is determined at a step S15 that the evaporative purging system 31 is normal, followed by terminating the abnormality determination at the step S17. By virtue of this processing, a time period required for the abnormality determination can be largely shortened. Further, if DP0 <DPM holds at the step S14, the program is immediately terminated.

According to the steps S12 to S17, if the initial pressure PINI is negative and at the same time the initial change rate DP0 exceeds the negative predetermined value DPM, the evaporative purging system is determined to be normal. Further, if the initial pressure PINI is positive and at the same time the absolute value of the initial change rate DP0 exceeds the positive predetermined value DPP, the abnormality determination is immediately terminated, i.e. suspended. As a result, the time period required for the abnormality determination can be largely shortened. When the abnormality determination is suspended, ordinary purging control is carried out depending on operating conditions of the engine.

If the answer to the question of the step S10 becomes negative (NO), i.e. if the second predetermined time period TE has elapsed from the start of this processing, the answer to the question of the step S11 also becomes negative (NO), and then the program proceeds to a step S18.

At the step S18, it is determined whether or not the value of the timer T exceeds the predetermined open-to-atmosphere time period TO. In the first loop of execution of the step S18, T<TO holds, and therefore the program proceeds to a step S19, wherein it is determined whether or not the tank internal pressure PTANK is lower than atmospheric pressure PATM. If PTANK≧PATM holds, the program is immediately terminated. On the other hand, the predetermined open-to-atmosphere time period TO has elapsed, the program proceeds from the step S18 to a step S20, wherein a negative pressurization mode permission flag FEVP1, which, when set to "1", indicates that execution of the negative pressurization mode is permitted, is set to "1" and at the same time the timer T is reset to "0", followed by terminating the present routine.

On the other hand, if PTANK<PATM holds at the step S19, the step S20 is executed even if the predetermined open-to-atmosphere time period TO has not elapsed, followed by terminating the present routine.

By executing the above processing, when the initial pressure PINI assumes a positive value, the tank internal pressure PTANK drops to a value almost equal to the atmospheric pressure PATM (corresponding to the time point t1 in FIG. 11).

Figure 7:
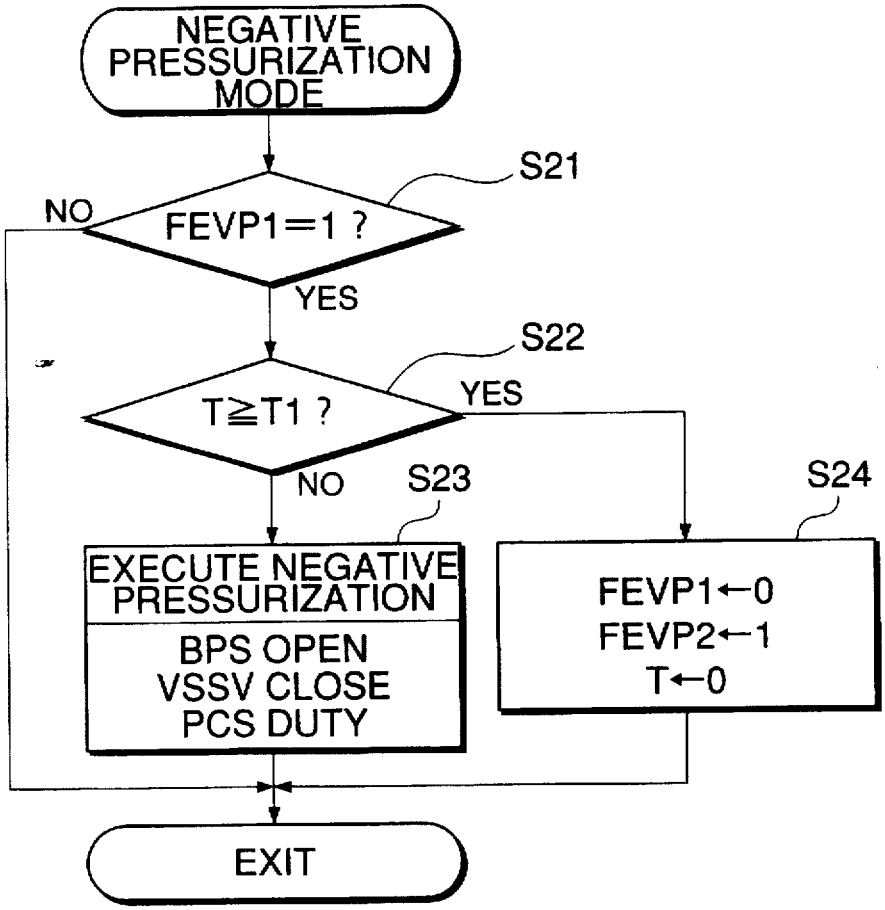
FIG. 7 is a flowchart showing a subroutine for carrying out a negative pressurization mode processing, which is executed at a step S4 in FIG. 2.

FIG. 7 shows a subroutine for carrying out the negative pressurization mode processing executed at the step S4 in FIG. 2 (corresponding to the time point t1 to a time point t2 in FIG. 11).

First, at a step S21, it is determined whether or not the negative pressurization mode permission flag FEVP1 has been set to "1". If FEVP1 =0 holds, which means that execution of the negative pressurization mode is not permitted, the program is immediately terminated.

On the other hand, if FEVP1=1 holds at the step S21, it is determined at a step S22 whether or not the value of the timer T exceeds a predetermined negative pressurization time period T1. In the first loop of execution of the step S22, T<T1 holds, and therefore the negative pressurization mode is set by opening the bypass valve 24, closing the vent shut valve 26, and controlling the purge control valve 30, based on the duty ratio, followed by terminating the present routine. The duty control of the purge control valve 30 is carried out in the following manner: A desired flow rate table, not shown, stored beforehand in the memory means of the ECU 5 is retrieved to determine a desired purge flow rate QEVAP according to the tank internal pressure PTANK. The control duty ratio is determined according to the thus determined QEVAP value. The desired flow rate table is set such that the QEVAP value increases as the PTANK value increases.

When the predetermined negative pressurization time period T1 has elapsed, i.e. when T=T1 holds (the time point t2 in FIG. 11), the program proceeds to a step S24, wherein the negative pressurization mode permission flag FEVP1 is set to "0", and a leakage-checking mode permission flag FEVP2, which, when set to "1", indicates that execution of the leakage-checking mode is permitted, is set to "1" and at the same time the timer T is reset to "0", followed by terminating the present routine.

By executing the above processing, the negative pressure within the intake pipe 2 of the engine is introduced into the evaporative purging system 31, whereby the tank internal pressure PTANK drops to a value P0.

Figure 8:
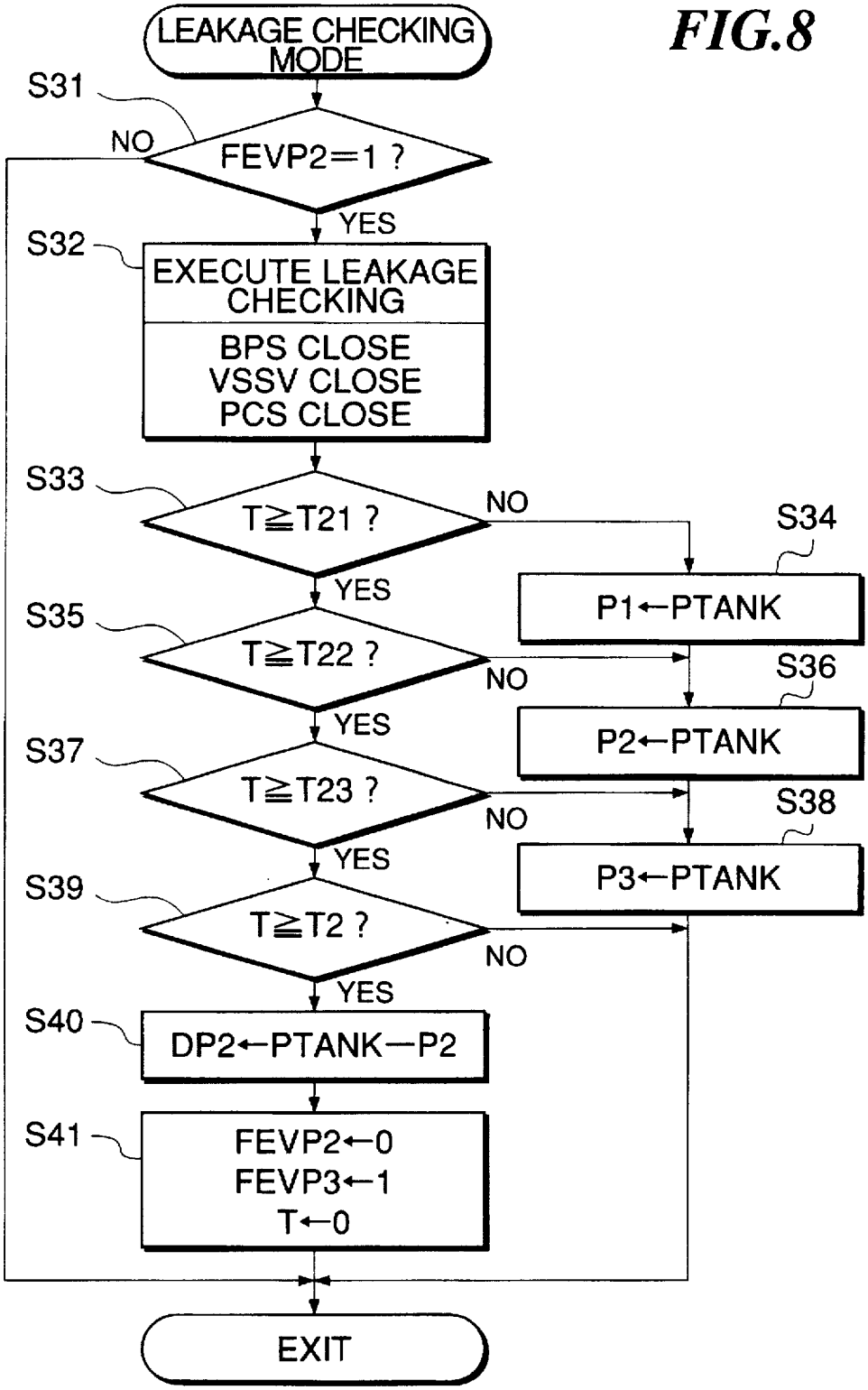
FIG. 8 is a flowchart showing a subroutine for carrying out a leakage-checking mode processing, which is executed at a step S5 in FIG. 2.

FIG. 8 shows a subroutine for carrying out the leakage-checking mode processing executed at the step S5 in FIG. 2 (corresponding to the time point t2 to a time point t3 in FIG. 11).

First, at a step S31, it is determined whether or not the leakage-checking mode permission flag FEVP2 has been set to "1". If FEVP2=0 holds, i.e. if execution of the leakage-checking mode is not permitted, the program is immediately terminated.

On the other hand, if FEVP2=1 holds, i.e. if execution of the leakage-checking mode is permitted, the bypass valve 24, the vent shut valve 26, and the purge control valve 30 are all closed to execute the leakage checking at a step S32. At the following step S33, it is determined whether or not the value of the timer T exceeds a first predetermined time period T21. In the first loop of execution of the step S33, T<T21 holds, and then a present value of the tank internal pressure PTANK is set to a first detected pressure P1, a second detected pressure P2, and a third detected pressure P3, at respective steps S34, S36, and S38, followed by terminating the present routine.

When the first predetermined time period T21 has elapsed, the program proceeds from the step S33 to a step S35, wherein it is determined whether or not the value of the timer T exceeds a second predetermined time period T22. In the first loop of execution of the step S35, T<T22 holds, and then the second detected value P2 and the third detected value P3 are updated to a present value of the tank internal pressure PTANK at the respective steps S36 and S38, followed by terminating the present routine.

When the second predetermined time period T22 has elapsed, the program proceeds from the step S35 to a step S37, wherein it is determined whether or not the value of the timer T exceeds a third predetermined time period T23. In the first loop of execution of the step S37, T<T23 holds, and then the third detected value P3 is updated to a present value of the tank internal pressure PTANK at the step S38, followed by terminating the present routine.

When the third predetermined time period T23 has elapsed, the program proceeds from the step S37 to a step S39, wherein it is determined whether or not the value of the timer T exceeds a predetermined leakage-checking time period T2. In the first loop of execution of the step S39, T<T2 holds, and then the program is immediately terminated.

By executing the step S33 to the step S38, as shown in FIG. 8, the tank internal pressure PTANK detected when the first predetermined time period T21 elapses from the leakage-checking mode starting time point t2 is set to the first detected pressure P1, the tank internal pressure PTANK detected when the second predetermined time period T22 elapses from the time point t2 is set to the second detected pressure P2, and the tank internal pressure PTANK detected when the third predetermined time period T23 elapses from the time point t2 is set to the third detected pressure P3, respectively.

When the predetermined leakage-checking time period T2 has elapsed from the time pint t2, the program proceeds from the step S39 to a step S40, wherein a pressure difference DP2 (=PLCEND−P2, hereinafter referred to as "the second pressure difference") between a present value of the tank internal pressure PTANK (tank internal pressure PLCEND assumed at the time point t3 in FIG. 11) and the second detected pressure P2 is calculated. Then, at a step S41, the leakage-checking mode permission flag FEVP2 is set to "0", a pressure-recovering mode permission flag FEVP3, which, when set to "1", indicates that execution of the pressure recovering-mode is permitted, is set to "1", and the timer T is reset to "0", followed by terminating the present routine.

Figure 9:
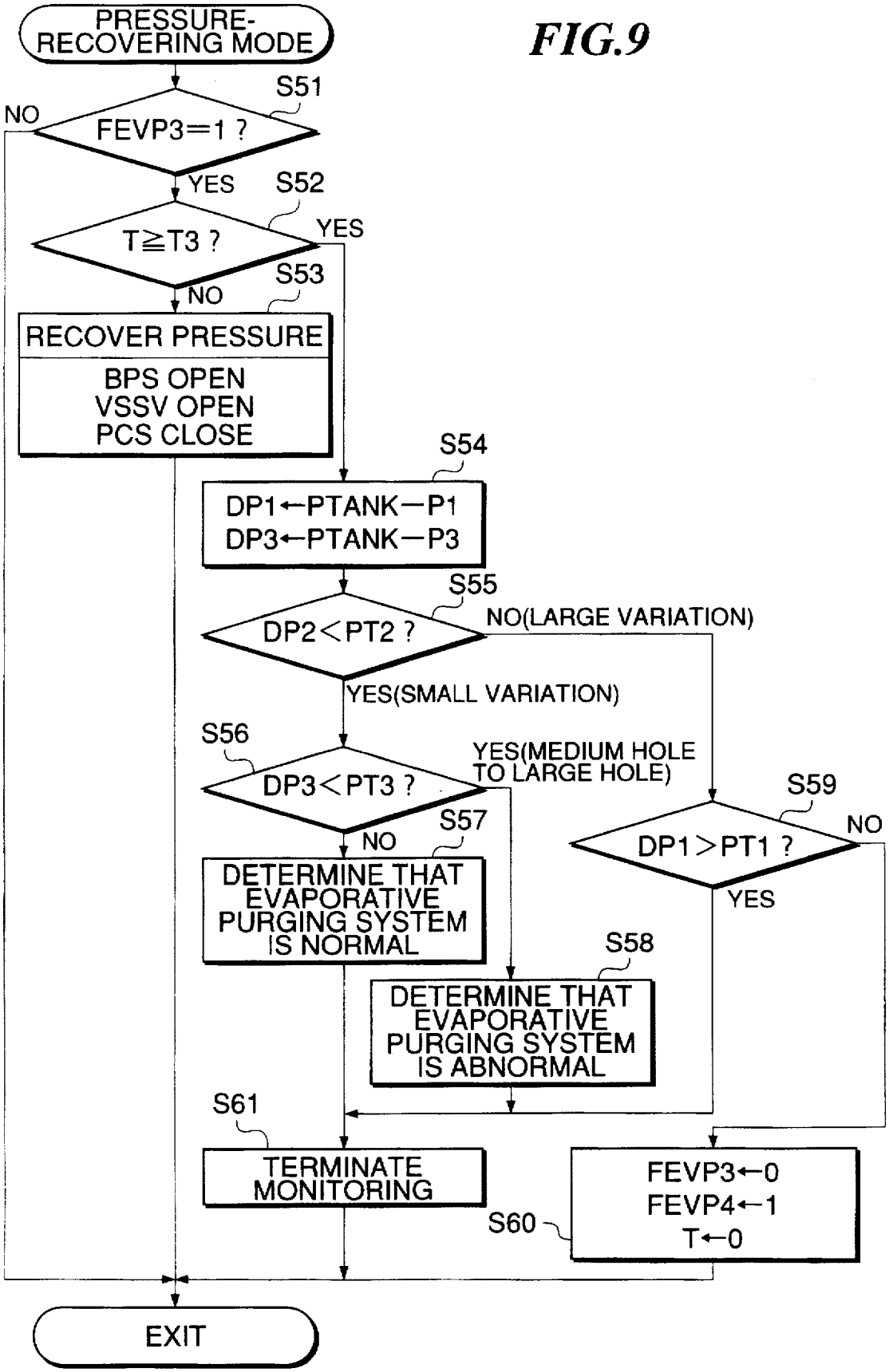
FIG. 9 is a flowchart showing a subroutine for carrying out a pressure-recovering mode processing, which is executed at a step S6 in FIG. 2.

FIG. 9 shows a subroutine for carrying out the pressure-recovering mode processing executed at the step S6 in FIG. 2 (corresponding to the time point t3 to a time point t4 in FIG. 11).

First, at a step S51, it is determined whether or not the pressure-recovering mode permission flag FEVP3 has been set to "1". If FEVP3=0 holds, i.e. if execution of the pressure-recovering mode is not permitted, the program is immediately terminated.

On the other hand, if FEVP3=1 holds at the step S51, it is determined at a step S52 whether or not the value of the timer T exceeds a predetermined pressure-recovering time period T3. In the first loop of execution of the step S52, T<T3 holds, and then the program proceeds to a step S53, wherein the pressure-recovering mode is set by opening the bypass valve 24 and the vent shut valve 26, and closing the purge control valve 30 (the same valve states as in the open-to-atmosphere mode), followed by terminating the present routine.

If the predetermined pressure-recovering time period T3 has elapsed, the program proceeds from the step S52 to a step S54, wherein calculations are made of a pressure difference DP1 (=PPREND–P1, hereinafter referred to as "the first pressure difference" ) between a present value of the tank internal pressure PTANK (tank internal pressure PPREND assumed when the pressure-recovering mode is terminated at the time point t4 in FIG. 11) and the first detected pressure P1, and a pressure difference DP3 (=PPREND P3, hereinafter referred to as "the third pressure difference") between the value PPREND and the third detected pressure P3. Further, it is determined at a step S55 whether or not the second pressure difference DP2 is smaller than a second threshold value PT2.

If DP2<PT2 holds at the step S55, which means that a change in pressure during the leakage-checking mode is small, it is determined that the evaporative purging system 31 is normal or it has a medium-sized hole or a large-sized hole formed therein. Then, it is determined at a step S56 whether or not the third pressure difference DP3 is smaller than a third threshold value PT3. If DP3 <PT3 holds, which means that the third detected pressure P3 is lower than the tank internal pressure PPREND (almost equal to the atmospheric pressure PATM) at the time point t4 by a predetermined amount or more. Therefore, it is determined at a step S57 that the evaporative purging system 31 is normal, and then the abnormality-determination is terminated at a step S61 without executing a processing of FIG. 10, hereinafter described.

On the other hand, if DP3 <TP3 holds at the step S56, which means that the third detected pressure P3 is almost equal to the atmospheric pressure PATM, it is determined at a step S58 that a large-sized hole or a medium-sized hole is present in the evaporative purging system 31. Therefore, the program is terminated at the step S61 without executing the processing of FIG.10.

On the other hand, if DP2 ≧PT2 holds at the step S55, which means that the change in pressure during the leakage-checking mode is large, it is determined that the cut-off valve 21 is closed (i.e. the fuel tank 9 is full), or the evaporative purging system 31 is normal and at the same time evaporative fuel is generated in the fuel tank 9 in an extremely large amount, or a small hole is present in the system 31. Then, it is determined at a step S59 whether or not the first pressure difference DP1 is larger than the first threshold value PT1. If DP1 >TP1 holds, which means that the first detected pressure DP1 is low, it is determined that the fuel tank 9 is full to close the cut-off valve 21. Therefore, the determination as to abnormality is suspended, and the abnormality determination is terminated at the step S61 without executing the processing of FIG. 10.

If DP1<PT1 holds at the step S59, it is determined that the system 31 is normal or has a small hole formed therein. Then, at a step S60, the pressure-recovering mode permission flag FEVP3 is set to "0", a corrective checking mode permission flag FEVP4, which, when set to "1", indicates that execution of the corrective checking mode is permitted, is set to "1", and the timer T is reset to "0", followed by terminating the present routine.

Figure 10:
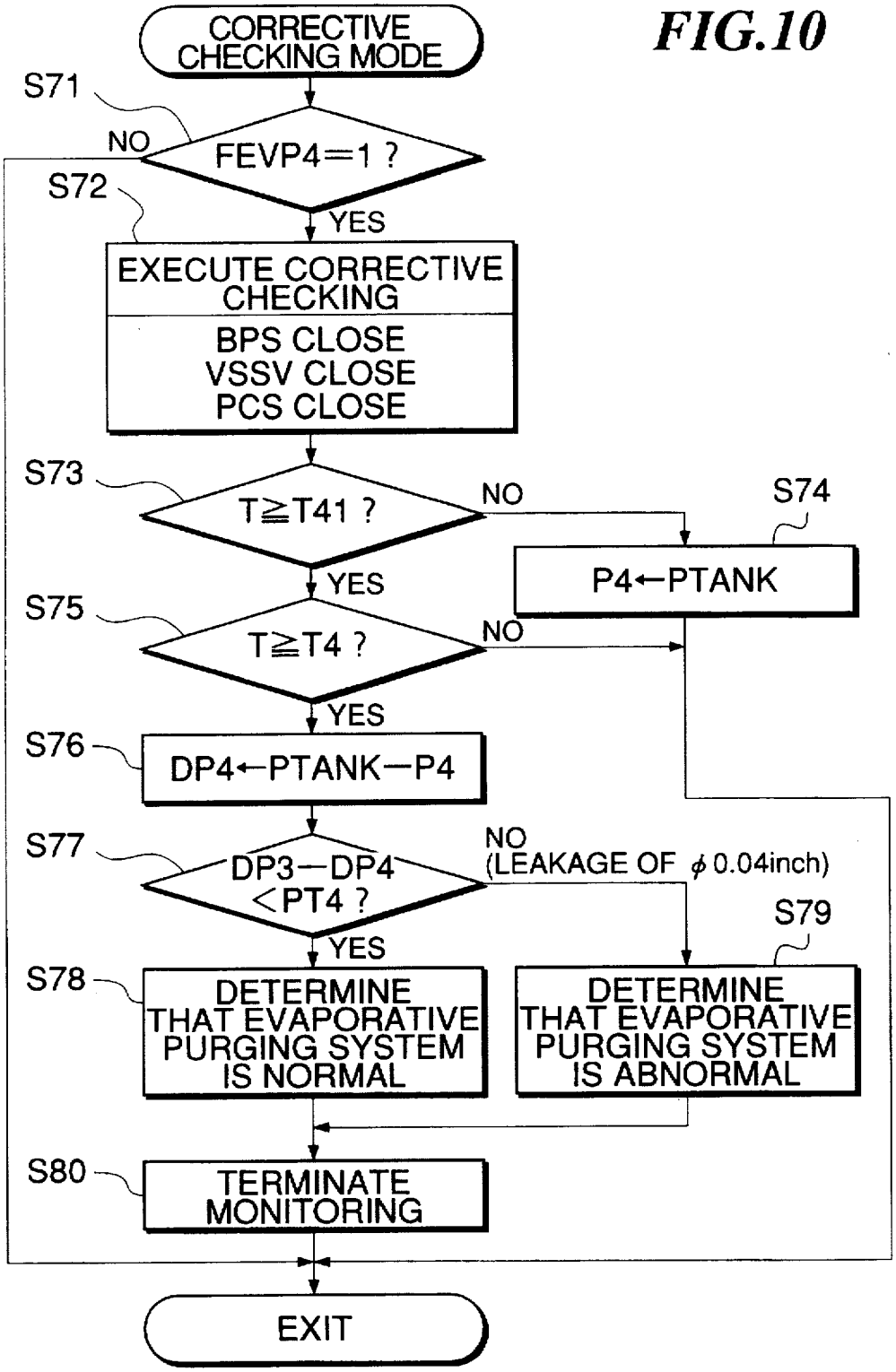
FIG. 10 is a flowchart showing a subroutine for carrying out a corrective checking mode processing, which is executed at a step S7 in FIG. 2.

FIG. 10 shows a subroutine for carrying out the corrective checking mode processing executed at the step S7 in FIG. 2 (corresponding to the time point t4 to a time point t5 in FIG. 11).

First, at a step S71, it is determined whether or not the corrective checking mode permission flag FEVP4 assumes "1". If FEVP4 =0 holds, i.e. if execution of the corrective checking mode processing is not permitted, the program is immediately terminated.

If FEVP4 =1 holds at the step S71, the program proceeds to a step S72, wherein the bypass valve 24, the vent shut valve 26 and the purge control valve 30 are all closed, similarly to the leakage-checking mode, to thereby execute the corrective checking mode processing. Then, it is determined at a step S73 whether or not the value of the timer T exceeds a predetermined delay time T41. In the first loop of execution of the step S73, T<T41 holds, and then the program proceeds to a step S74, wherein a present value of the tank internal pressure PTANK is set to a fourth detected pressure P4, followed by terminating the present routine.

After the predetermined delay time T41 has elapsed, the program proceeds from the step S73 to a step S75, and therefore the fourth detected pressure P4 is updated to a value of the tank internal pressure PTANK assumed when the predetermined delay time T41 has elapsed from the corrective checking mode starting time point t4.

At the step S75, it is determined whether or not the value of the timer T exceeds a predetermined corrective checking time period T4. In the first loop of execution of the step S75, T<T4 holds, and then the present program is immediately terminated. If T=T4 holds, the program proceeds from the step S75 to a step S76.

At the step S76, a pressure difference DP4 (=PCCEND–P4, hereinafter referred to as "the fourth pressure difference") between a present value of the tank internal pressure PTANK (tank internal pressure PCCEND assumed at the time point t5 in FIG. 11) and the fourth detected pressure P4 is calculated. Then, it is determined at a step S77 whether or not a difference (=DP3 –DP4 ) between the third pressure difference DP3 and the fourth pressure difference DP4 is smaller than a fourth threshold value PT4.

If (DP3 <DP4 )<PT4 holds, which means that the difference between the third pressure difference DP3 and the fourth pressure difference DP4 is small, it is determined at a step S78 that the large change in pressure (second pressure difference DP2 ) during the leakage-checking mode was caused by generation of a large amount of evaporative fuel and hence the evaporative purging system 31 is normal, followed by terminating the abnormality determination at a step S80.

On the other hand, if (DP3–DP4)≧PT4 holds, it is determined at a step S79 that the large change in pressure (second pressure difference DP2) during the leakage-checking mode was caused by a small hole (e.g. a hole with a diameter of approximately 0.04 inches) present in the evaporative purging system 31, followed by terminating the abnormality determination at the step S80.

According to the present embodiment, as described above, if the intake air temperature TA and the engine coolant temperature TW are both low, and the absolute value of the difference between the intake air temperature TA and the engine coolant temperature TW is small, i.e. in the case where the engine 1 is started in a cold state after it has been inoperative over a long time period, almost no evaporative fuel can be generated within a predetermined time period after the start of the engine, and therefore, even if the leakage checking of the evaporative purging system 31 is carried out on such an occasion, there is almost no fear that the drivability of the engine is degraded during negative pressurization of the evaporative purging system 31 and the evaporative purging system 31 is erroneously determined to suffer from leakage. Therefore, the leakage-checking-inhibiting threshold value KEVPELK is changed from the value KEVPELK0 to the value KEVPELK1 such that the conditions for permitting execution of the leakage checking are mitigated only during the predetermined time period from the start of the engine 1 in a cold state.

As a result, the conditions for permitting execution of the leakage checking are mitigated in an engine operating condition where the possibility of erroneous detection of leakage is small, to thereby increase the frequency of the leakage checking. On the other hand, the conditions for permitting execution of the leakage checking are returned to original ones in an engine operating condition where a large amount of evaporative fuel can be generated, to thereby prevent an erroneous determination as to leakage as well as degraded drivability of the engine.

Although in the above described embodiment the fuel injection amount correction term KO2 x KEVAP is employed as one of the conditions for permitting the abnormality determination, this is not limitative, but the air-fuel ratio correction coefficient KO2 alone may be employed and compared with a predetermined lower limit value during the negative pressurization, whereby if the coefficient KO2 exceeds the predetermined lower limit value, the abnormality determination is inhibited, and the predetermined lower limit value may be changed to a lower value within a predetermined time period after the start of the engine in a cold state. Further alternatively, the fuel tank may be closed by closing the bypass valve 24 before the execution of the negative pressurization, and an amount of change in the fuel tank pressure PTANK may be detected and compared with a predetermined value, and if the former exceeds the latter within a predetermined time period after the start of the engine in a cold state, the abnormality determination may be inhibited.

What is claimed is:

1. An evaporative fuel-processing system for an internal combustion engine having an intake system, and a fuel tank, comprising:

an evaporative emission control system including a canister having an adsorbent accommodated therein, for adsorbing evaporative fuel generated in said fuel tank, and an air inlet port communicating with atmosphere, a charging passage extending between said canister and said fuel tank, a purging passage extending between said canister and said intake system, a purge control valve arranged across said purging passage, and a vent shut valve disposed to open and close said air inlet port of said canister;

abnormality-determining means for determining an abnormality in said evaporative emission control system, said abnormality-determining means including pressure-detecting means for detecting pressure within said evaporative emission control system, negatively pressurizing means for negatively pressurizing an interior of said evaporative emission control system into a predetermined negatively pressurized state, by opening said purge control valve and closing said vent shut valve, and leakage-checking means for closing said purge control valve, and for determining whether said evaporative emission control system has leakage, based on a rate of decrease in negative pressure within said evaporative emission control system over a first predetermined time period;

evaporative fuel amount-detecting means for detecting an amount of evaporative fuel supplied from said canister to said engine;

terminating means for terminating operation of said abnormality-determining means when said amount of evaporative fuel detected by said evaporative fuel amount-detecting means exceeds a predetermined amount; and changing means for changing said predetermined amount in a direction of mitigating operation of said terminating means over a second predetermined time period after starting of said engine in a cold state.

2. An evaporative fuel-processing system as claimed in claim 1, wherein said engine has an exhaust system, oxygen concentration-detecting means arranged in said exhaust system, and air-fuel ratio control means for controlling an air-fuel ratio of an air-fuel mixture supplied to said engine by using an air-fuel ratio correction coefficient which is set in response to an output from said oxygen concentration-detecting means, said evaporative fuel amount-detecting means detecting said amount of evaporative fuel, based on said air-fuel ratio correction coefficient.

3. An evaporative fuel-processing system as claimed in claim 2, wherein said changing means sets said predetermined amount to a value smaller than a value set when said engine is started in a non-cold state or after said second predetermined time period has elapsed, over said second predetermined time period after said starting of said engine in said cold state.

4. An evaporative fuel-processing system as claimed in claim 3, wherein said air-fuel ratio control means controls said air-fuel ratio of said air-fuel mixture by using an evaporative fuel-dependent correction coefficient which is set in response to an amount or concentration of evaporative fuel supplied to said intake system through said purging passage, together with said air-fuel ratio correction coefficient, said evaporative fuel amount-detecting means detecting said amount of evaporative fuel, based on said air-fuel ratio correction coefficient and said evaporative fuel-dependent correction coefficient.

5. An evaporative fuel-processing system as claimed in claim 1, wherein said changing means changes said predetermined amount in said direction of mitigating said operation of said terminating means over said second predetermined time period after said engine is started under a condition that temperature of coolant of said engine and temperature of intake air supplied to said engine are both within respective predetermined low ranges and a difference between said temperature of said coolant of said engine and said temperature of said intake air is below a predetermined value.

* * * * *